US010236650B2

(12) United States Patent
Dai et al.

(10) Patent No.: US 10,236,650 B2
(45) Date of Patent: Mar. 19, 2019

(54) CONTACT BENDING UNIT AND CONTACT BENDING APPARATUS

(71) Applicants: Tyco Electronics (Shanghai) Co. Ltd., Shanghai (CN); Shenzhen AMI Technology Co., Ltd, Shenzhen (CN)

(72) Inventors: Zhiyong Dai, Shanghai (CN); Lvhai Hu, Shanghai (CN); Yingcong Deng, Shanghai (CN); Lei Zhou, Shanghai (CN); Yun Liu, Shanghai (CN); Qinglong Zeng, Guangdong (CN); Wei Kang, Guangdong (CN)

(73) Assignees: Tyco Electronics (Shanghai) Co. Ltd., Shanghai (CN); Shenzhen AMI Technology Co., Ltd., Shenzhen (CN)

( * ) Notice: Subject to any disclaimer, the term of this patent is extended or adjusted under 35 U.S.C. 154(b) by 0 days.

(21) Appl. No.: 15/623,566

(22) Filed: Jun. 15, 2017

(65) Prior Publication Data

US 2017/0365969 A1 Dec. 21, 2017

(30) Foreign Application Priority Data

Jun. 16, 2016 (CN) ..... 2016 1 0429035

(51) Int. Cl.

| | |
|---|---|
| ***H01R 43/04*** | (2006.01) |
| ***B21F 1/00*** | (2006.01) |
| ***B21D 11/10*** | (2006.01) |
| ***H01R 43/16*** | (2006.01) |
| ***B21D 7/022*** | (2006.01) |
| ***B21D 7/024*** | (2006.01) |

(52) U.S. Cl.

CPC ..... *H01R 43/04* (2013.01); *B21D 7/022* (2013.01); *B21D 7/024* (2013.01); *B21D 11/10* (2013.01); *B21F 1/004* (2013.01); *H01R 43/16* (2013.01)

(58) Field of Classification Search

CPC ..... H05K 13/0092; H05K 13/0443; H05K 13/0473; H05K 13/026; H01L 21/4842; B21D 5/042; B21D 7/022; B21D 7/024; B21D 11/10; H01R 43/04; H01R 43/16; B21F 1/004

USPC ..... 140/105; 72/319

See application file for complete search history.

(56) References Cited

U.S. PATENT DOCUMENTS 3,435,857 A * 4/1969 Welch ..... H05K 13/0473 140/71 R
4,153,082 A * 5/1979 Foley ..... H05K 13/0473 140/105
4,183,383 A * 1/1980 Gudmestad ..... H01R 43/28 140/105
4,481,984 A * 11/1984 Linker ..... H05K 13/026 140/147
4,630,354 A * 12/1986 Staviski ..... H05K 13/0473 140/105
4,711,015 A * 12/1987 Tega ..... H05K 13/0443 140/105
4,860,801 A * 8/1989 Nicholas ..... H01R 43/28 140/105

(Continued)

*Primary Examiner* — David B Jones
(74) *Attorney, Agent, or Firm* — Barley Snyder

(57) ABSTRACT

A contact bending unit comprises a frame and a bending tool pivotally mounted on the frame. The bending tool has a row of receiving slots formed in a bottom surface of the bending tool receiving a plurality of contacts. The bending tool bends the contacts when the bending tool is rotated.

16 Claims, 7 Drawing Sheets

(56) References Cited

U.S. PATENT DOCUMENTS

| | | | | | |
|---|---|---|---|---|---|
| 5,027,866 | A * | 7/1991 | Matsumoto | H05K 13/0092 | 140/105 |
| 5,063,975 | A * | 11/1991 | Linker | H05K 13/0092 | 140/123 |
| 5,158,121 | A * | 10/1992 | Ishii | H05K 13/0092 | 140/105 |
| 6,363,976 | B1 * | 4/2002 | Aoki | H01L 21/4842 | 140/105 |
| 8,087,278 | B2 * | 1/2012 | Deis | B21D 5/042 | 72/319 |

* cited by examiner

CONTACT BENDING UNIT AND CONTACT BENDING APPARATUS

CROSS-REFERENCE TO RELATED APPLICATION

This application claims the benefit of the filing date under 35 U.S.C. § 119(a)-(d) of Chinese Patent Application No. 201610429035.6, filed on Jun. 16, 2016.

FIELD OF THE INVENTION

The present invention relates to a bending unit and, more particularly, to a bending unit for bending contacts of an electrical connector.

BACKGROUND

During the manufacture of an electrical connector, it is sometimes necessary to bend a conductive contact of the connector by a preset angle, for example, 90°. In the prior art, the conductive contact is bent manually.

Using known manual bending, each conductive contact must be bent individually; a row of contacts cannot be bent simultaneously, which limits efficiency. Furthermore, it is difficult to ensure accuracy when manually bending the conductive contact. Errors in the bended position make it difficult to mount the conductive contact onto a circuit board. Additionally, when bending manually, a worker needs to clamp the conductive contact with tools such as pliers, which creates scratches on a surface of the conductive contacts, degrading the quality of the conductive contacts.

SUMMARY

A contact bending unit according to the invention comprises a frame and a bending tool pivotally mounted on the frame. The bending tool has a row of receiving slots formed in a bottom surface of the bending tool receiving a plurality of contacts. The bending tool bends the contacts when the bending tool is rotated.

BRIEF DESCRIPTION OF THE DRAWINGS

The invention will now be described by way of example with reference to the accompanying Figures, of which.

DETAILED DESCRIPTION OF THE EMBODIMENTS

Figure 1:
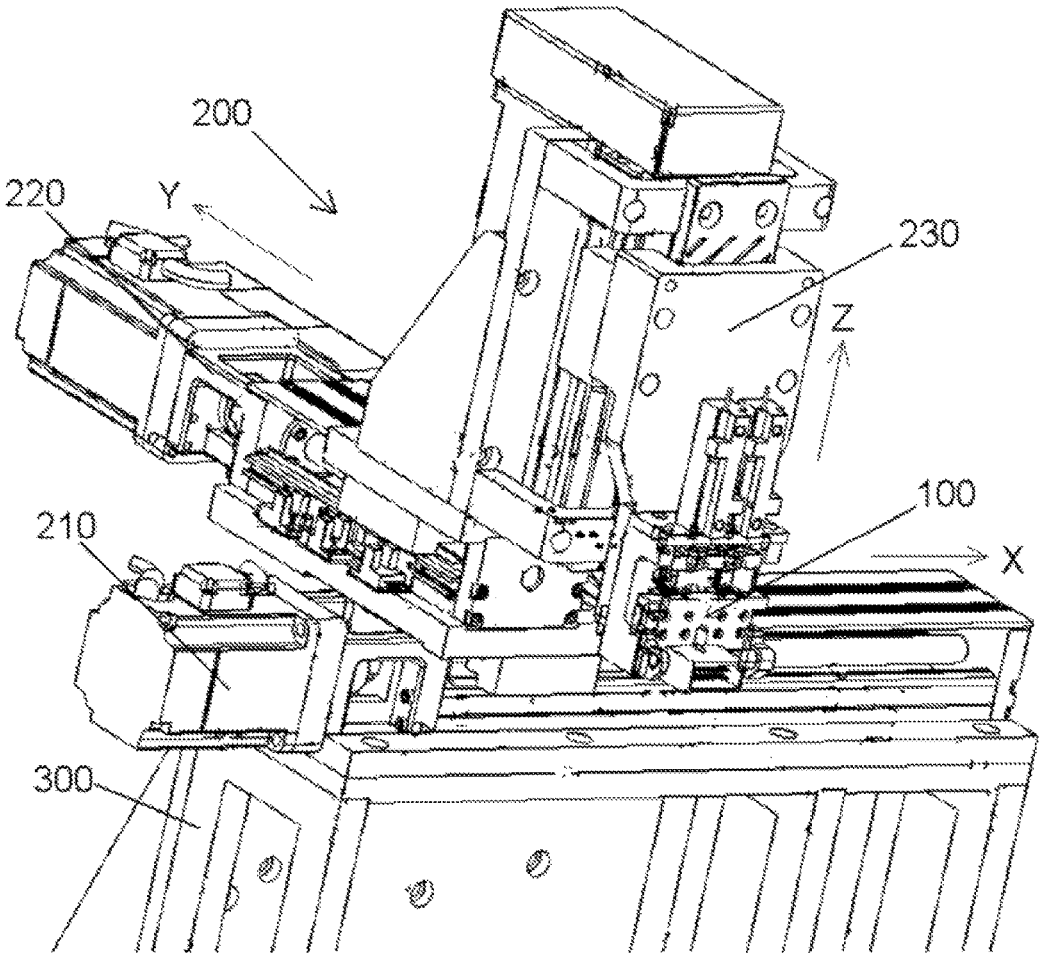
FIG. 1 is a perspective view of a contact bending apparatus according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A contact bending apparatus according to the invention is shown in FIG. 1. The contact bending apparatus comprises a contact bending unit 100, a moving mechanism 200, and a fixed base 300. The major components of the invention will now be described in greater detail.

Figure 2:
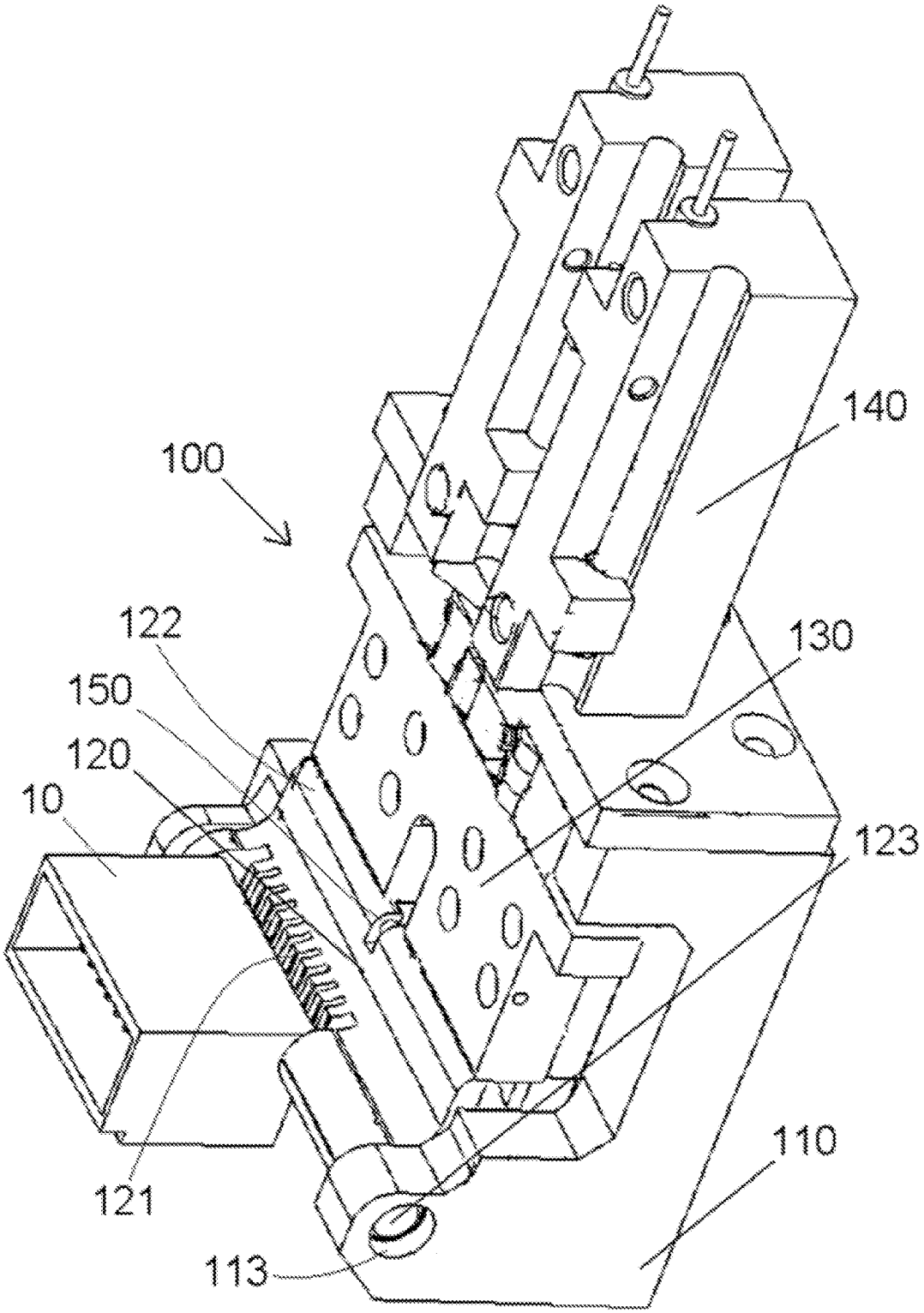
FIG. 2 is a perspective view of a contact bending unit of the contact bending apparatus.

The contact bending unit 100, as shown in FIG. 2, has a frame 110 and a bending tool 120 pivotally mounted on the frame 110. A pivot hole 113 is formed in one of the frame 110 and the bending tool 120, and a pivot shaft 123 adapted to be mated with the pivot hole 113 is formed in the other of the frame 110 and the bending tool 120. The pivot shaft 123 is mounted in the pivot hole 113 such that the bending tool 120 is pivotally mounted on the frame. A row of receiving slots 121 is formed in a bottom surface of the bending tool 120.

The contact bending unit 100, as shown in FIGS. 2-5, has a pair of drive mechanisms 130, 140 which are mounted on the frame 110 and adapted to drive the bending tool 120 to rotate about the pivot shaft 123. The drive mechanisms 130, 140 include a slider 130 slidably mounted on the frame 110 and a linear actuator 140 fixedly mounted on the frame 110 and adapted to push the slider 130 to slide on the frame 110. The slider 130 is driven to press the bending tool 120 so that the bending tool 120 rotates about the pivot shaft 123 when the linear actuator 140 pushes the slider 130 to slide. In an embodiment, the linear actuator 140 is a cylinder or a hydraulic cylinder.

Figure 3:
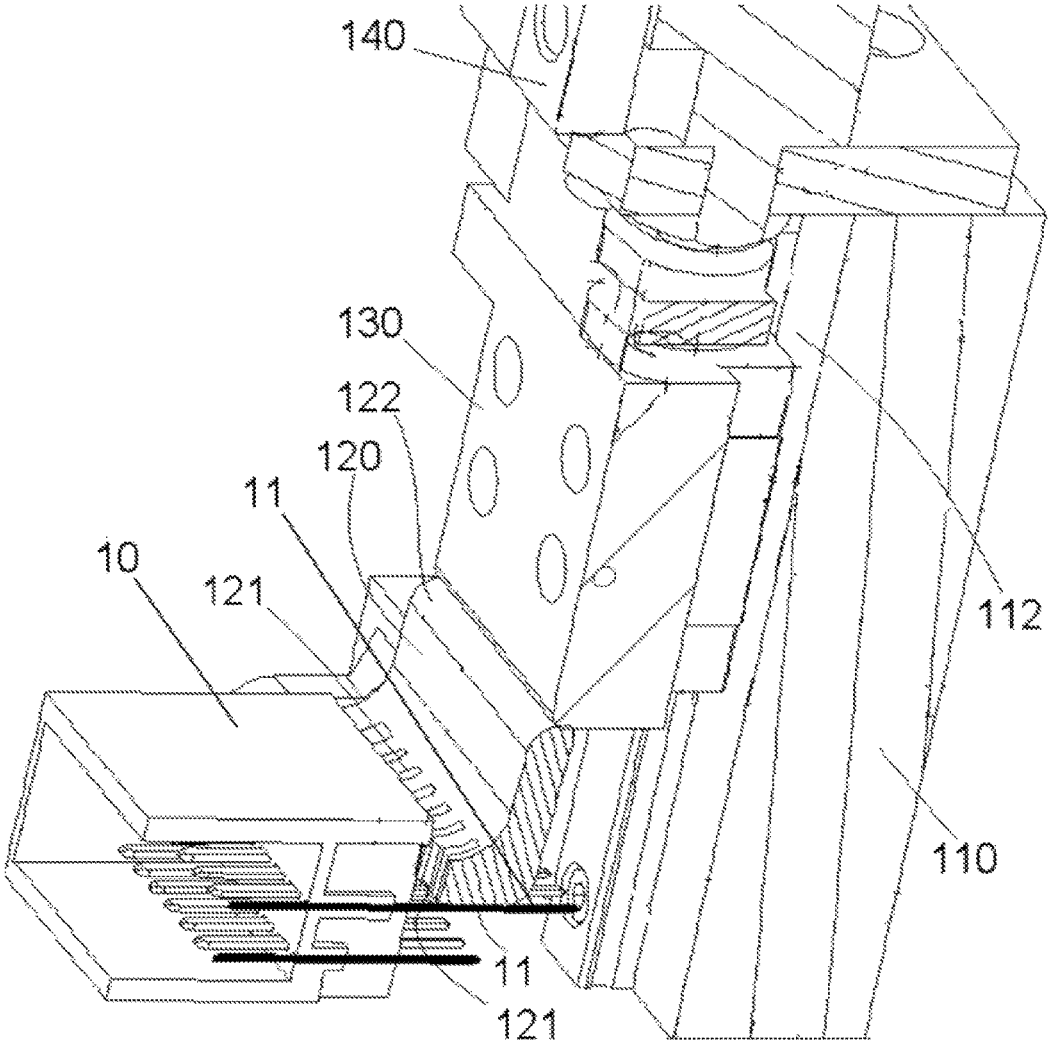
FIG. 3 is a sectional view of the contact bending unit in an initial position.
Figure 4:
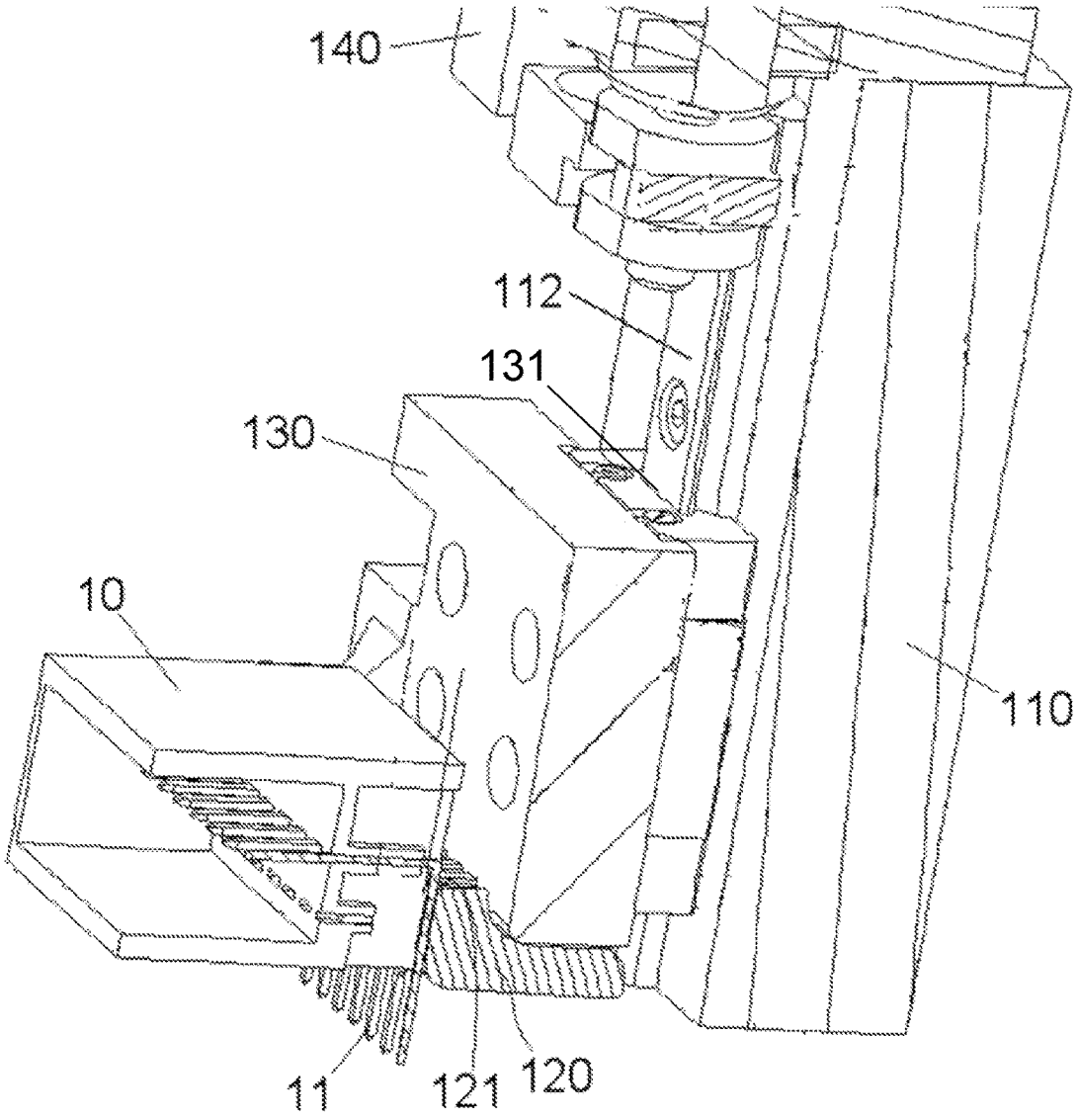
FIG. 4 is a sectional view of the contact bending unit in a final position.
Figure 5:
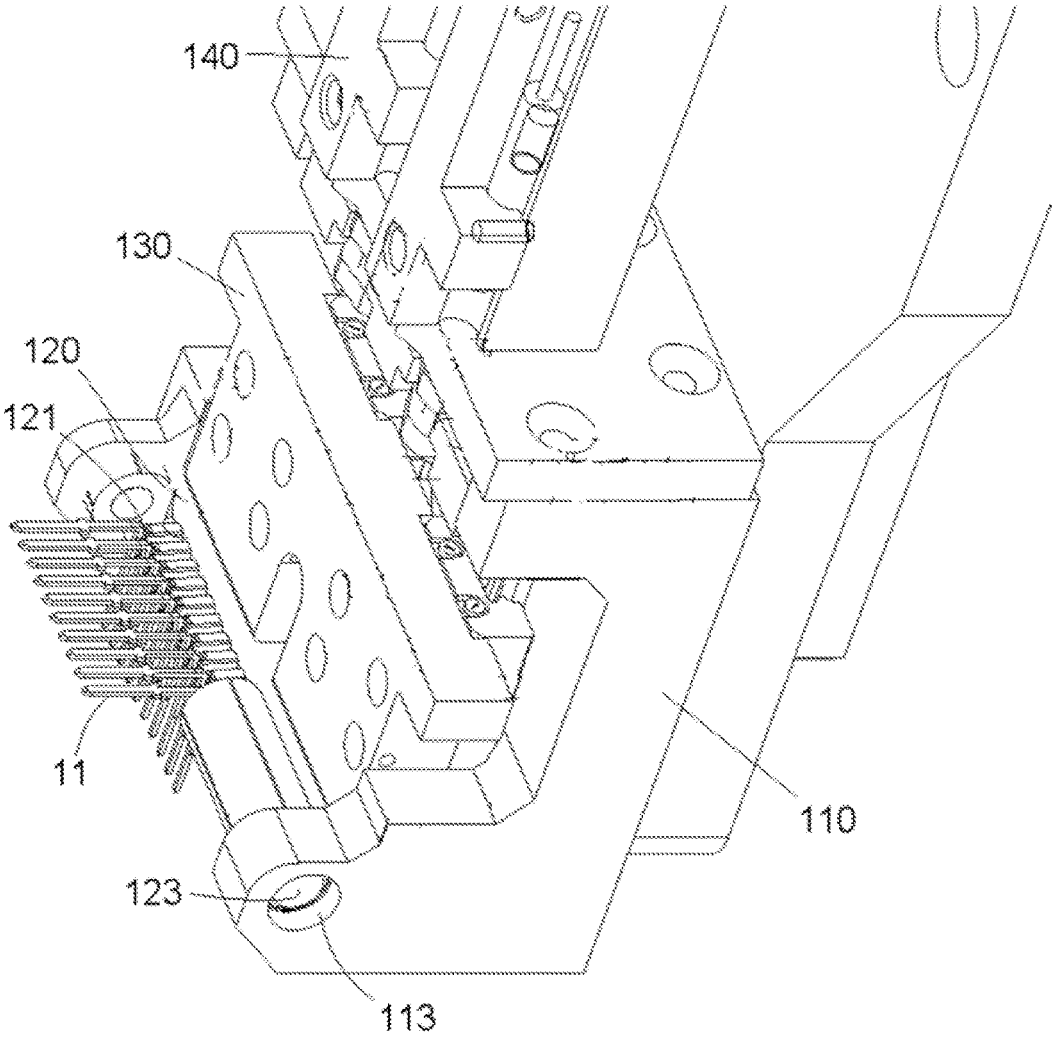
FIG. 5 is a perspective view of the contact bending unit in the final position and a contact.

A slide rail 112, as shown in FIGS. 3-5, is formed on one of the frame 110 and the slider 130, and a chute 131 adapted to be mated with the slide rail 112 is formed on the other of the frame 110 and the slider 130. The slide rail 112 is fitted in the chute 131 such that the slider 130 is slidably mounted on the frame 110.

A smooth curved surface 122 shown in FIGS. 2 and 3 is formed on a front face of the bending tool 120 which comes into contact with the slider 130, and the slider 130 slides along the smooth curved surface 122 of the bending tool 120 during the rotation of the bending tool 120 driven by the drive mechanism 130, 140. In this way, the frictional force between the slider 130 and the bending tool 120 is reduced to facilitate rotation of the bending tool 120 from the initial position shown in FIG. 3 to the final position shown in FIG. 4.

The contact bending unit 100, as shown in FIG. 2, has a resilient reset mechanism 150 connected to the bending tool 120. In the shown embodiment, the resilient reset mechanism 150 is a spring.

The moving mechanism 200, as shown in FIG. 1, is a moving platform movable in a first direction X, a second direction Y and a third direction Z which are perpendicular to one other. The moving mechanism 200 has a first moving mechanism 210 moving in the first direction X, a second moving mechanism 220 moving in the second direction Y and a third moving mechanism 230 moving in the third direction Z. The second moving mechanism 220 is mounted on the first moving mechanism 210 and the third moving mechanism 230 is mounted on the second moving mechanism 220.

The frame 110 of the contact bending unit 100 is fixedly mounted on the moving mechanism 200, as shown in FIG. 1. The frame 110 is mounted on the third moving mechanism 230 such that the frame 110 is movable with the first moving mechanism 210, the second moving mechanism 220 and the third moving mechanism 230. The moving mechanism 200 is mounted on the fixed base 300.

A process of bending a row of contacts 11 of a connector 10 using the contact bending unit 100 is shown in FIGS. 6A-6D.

Figure 6A:
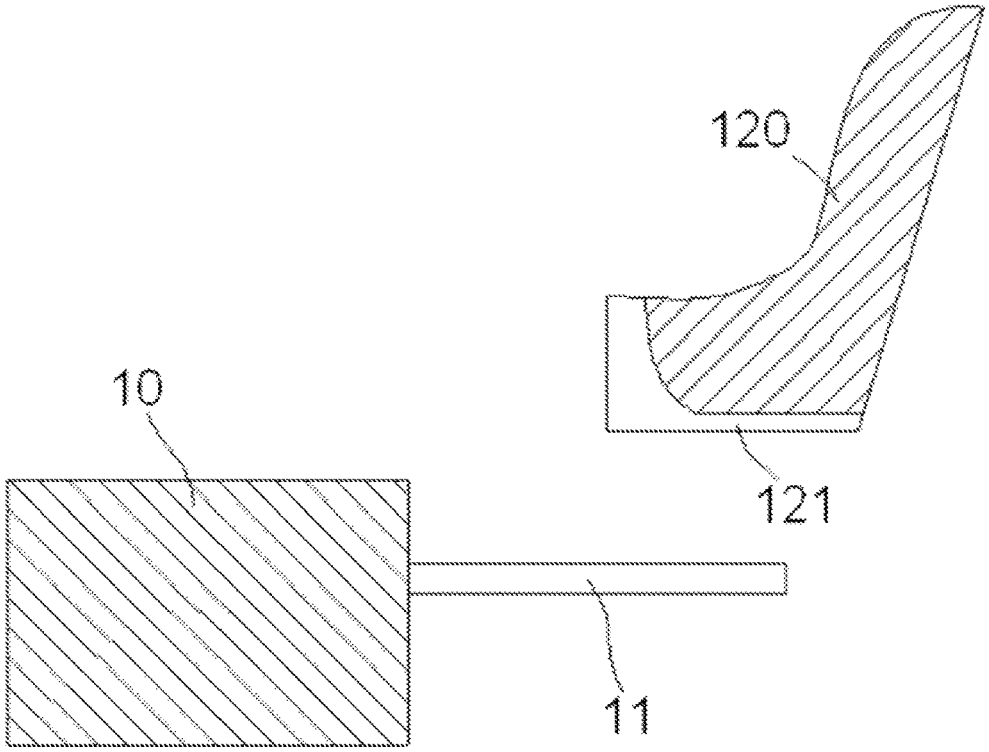
FIG. 6A is a sectional view of a bending tool of the contact bending unit and a row of contacts in a first step of a process of bending the row of contacts with the contact bending unit.
Figure 6B:
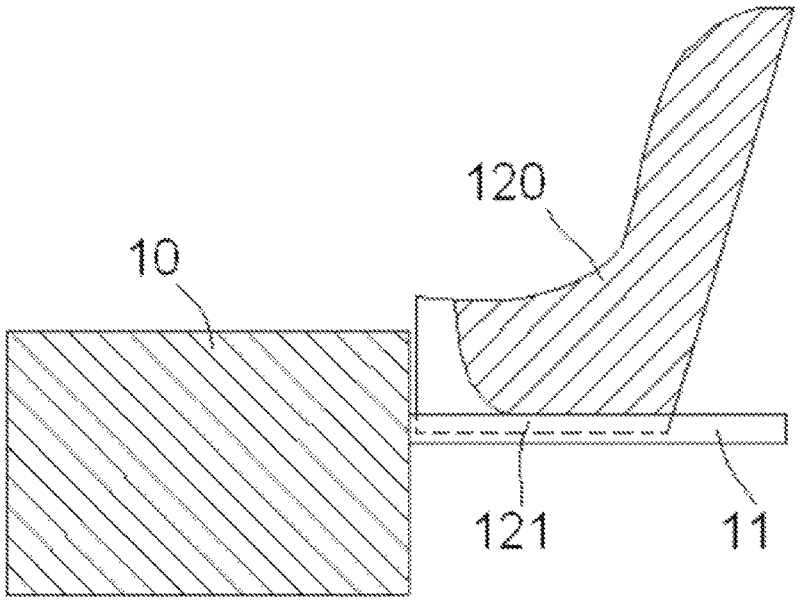
FIG. 6B is a sectional view of the bending tool and the row of contacts in a second step of the process.

First, as shown in FIG. 6A, the bending tool 120 of the contact bending unit 100 is moved to the initial position shown in FIGS. 3 and 6B by the moving mechanism 200. At the initial position shown in FIGS. 3 and 6B, the bending tool 120 of the contact bending unit 100 is located just above the row of contacts 11 to be bent, and the row of contacts 11 is received and positioned in the row of receiving slots 121 of the bending tool 120.

Figure 6C:
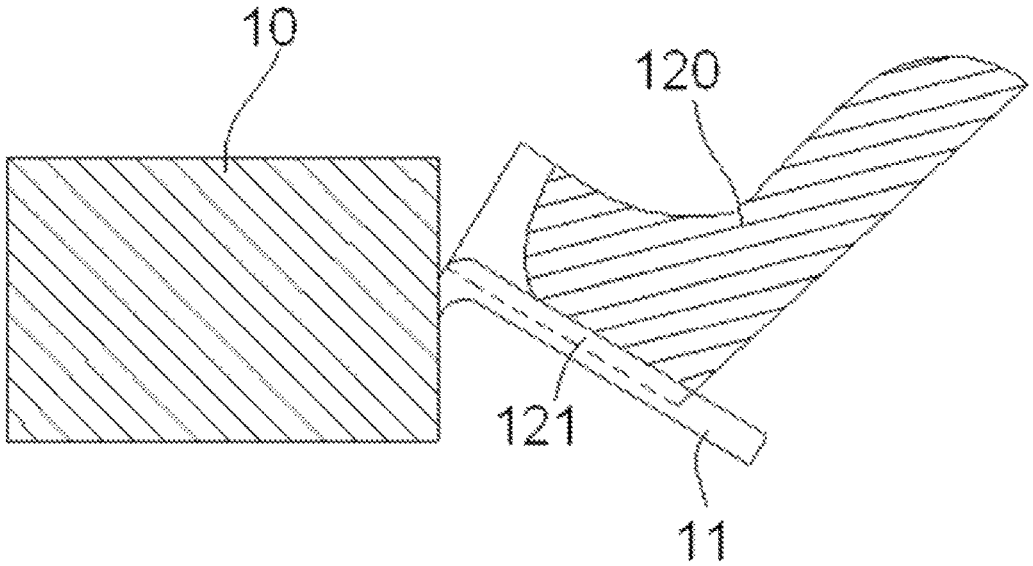
FIG. 6C is a sectional view of the bending tool and the row of contacts in a third step of the process.

As shown in FIG. 6C, the bending tool 120 is then driven to rotate about the pivot shaft 123 by the drive mechanisms 130, 140 so that the row of the contacts 11 received in the row of receiving slots 121 are gradually bent under the pressing of the bending tool 120.

Figure 6D:
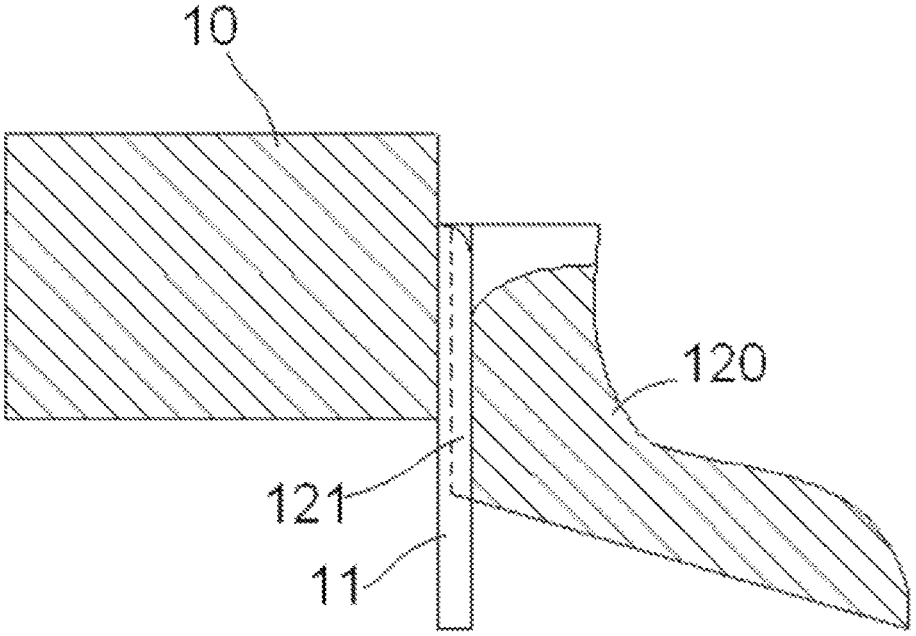
FIG. 6D is a sectional view of the bending tool and the row of contacts in a final step of the process.

Finally, as shown in FIGS. 4-5 and 6D, after the bending tool 120 is rotated by 90 degrees, the row of contacts 11 are bent by 90 degrees, thereby completing the bending operation of the contacts 11. The resilient reset mechanism 150 restores the bending tool 120 to the initial position after the bending of the contacts 11 is finished.

As shown in FIGS. 6B, 6C and 6D, during the entire process of bending, the contacts 11 are always received and positioned in the receiving slots 121 formed in the bottom surface of the contact bending tool 120, and there are not any positional offsets, ensuring the positional accuracy of the bent contacts.

In the shown embodiment, the bending tool 120 simultaneously bends a plurality of contacts 11 arranged in a row. The bending tool 120 may alternatively bend a single contact 11.

Advantageously, in the contact bending apparatus according to the invention, it is only necessary to rotate the bending tool to achieve bending of the contacts, thereby improving the bending efficiency of the contacts. In addition, a row of contacts may be bent simultaneously by the bending tool, which further improves contact bending efficiency. Furthermore, during the bending, the surface of the contact in contact with the bending tool will not be scratched, ensuring the surface quality of the folded contacts. During the bending, the contacts are positioned in the corresponding receiving grooves of the contact bending tool, and there are not any positional offsets, ensuring the positional accuracy of the folded contacts.

What is claimed is:

1. A contact bending unit, comprising:

a frame;

a bending tool pivotally mounted on the frame, the bending tool having a row of receiving slots formed in a bottom surface of the bending tool receiving a plurality of contacts, the bending tool bending the contacts when the bending tool is rotated; and a pair of driving mechanisms mounted on the frame and driving the bending tool to rotate, the driving mechanisms including a slider slidably mounted on the frame and a linear actuator fixedly mounted on the frame and adapted to push the slider to slide on the frame, the slider pressing the bending tool so that the bending tool rotates when the linear actuator pushes the slider to slide on the frame, a front face of the bending tool is a smooth curved surface and the slider slides along the smooth curved surface during rotation of the bending tool.

2. The contact bending unit of claim 1, wherein the linear actuator is a hydraulic cylinder.

3. The contact bending unit of claim 1, wherein the frame has a slide rail and the slider has a chute, the slider fitted in the chute.

4. The contact bending unit of claim 1, further comprising a resilient reset mechanism connected to the bending tool and adapted to restore the bending tool to an initial position after bending of the contacts.

5. The contact bending unit of claim 4, wherein the resilient reset mechanism is a spring.

6. The contact bending unit of claim 1, wherein the frame has a pivot hole and the bending tool has a pivot shaft, the pivot shaft mounted in the pivot hole.

7. The contact bending unit of claim 1, wherein the contacts are arranged in a row and the bending tool simultaneously bends the contacts.

8. The contact bending unit of claim 1, wherein the bending tool bends only a single contact.

9. The contact bending unit of claim 1, wherein an angle of rotation of the bending tool is equal to an angle of bending of the contacts.

10. A contact bending apparatus, comprising:

a contact bending unit including a frame and a bending tool pivotally mounted on the frame, the bending tool having a row of receiving slots formed in a bottom surface of the bending tool receiving a plurality of contacts, the bending tool bending the contacts when the bending tool is rotated; and a moving mechanism on which the contact bending unit is mounted, the moving mechanism moving the contact bending unit to a preset position, the moving mechanism is a moving platform movable in a first direction, a second direction, and a third direction perpendicular to one another and having a first moving mechanism moving in the first direction, a second moving mechanism moving in the second direction, and a third moving mechanism moving in the third direction.

11. The contact bending apparatus of claim 10, wherein the frame is fixedly mounted on the moving mechanism.

12. The contact bending apparatus of claim 10, wherein the second moving mechanism is mounted on the first moving mechanism and the third moving mechanism is mounted the second moving mechanism.

13. The contact bending apparatus of claim 12, wherein the frame is mounted on the third moving mechanism and is movable with the first moving mechanism, the second moving mechanism, and the third moving mechanism.

14. The contact bending apparatus of claim 10, further comprising a fixed base on which the moving mechanism is mounted.

15. A contact bending unit, comprising:

a frame having a slide rail;

a bending tool pivotally mounted on the frame, the bending tool having a row of receiving slots formed in a bottom surface of the bending tool receiving a plurality of contacts, the bending tool bending the contacts when the bending tool is rotated; and a pair of driving mechanisms mounted on the frame and driving the bending tool to rotate, the driving mechanisms including a slider slidably mounted on the frame and a linear actuator fixedly mounted on the frame and adapted to push the slider to slide on the frame, the slider having a chute fitted on the slide rail of the frame, the slider pressing the bending tool so that the bending tool rotates when the linear actuator pushes the slider to slide on the frame.

16. A contact bending unit, comprising:

a frame;

a bending tool pivotally mounted on the frame, the bending tool having a row of receiving slots formed in a bottom surface of the bending tool receiving a single contact, the bending tool bending only the single contact when the bending tool is rotated; and a pair of driving mechanisms mounted on the frame and driving the bending tool to rotate, the driving mechanisms including a slider slidably mounted on the frame and a linear actuator fixedly mounted on the frame and adapted to push the slider to slide on the frame, the slider pressing the bending tool so that the bending tool rotates when the linear actuator pushes the slider to slide on the frame, a front face of the bending tool is a smooth curved surface and the slider slides along the smooth curved surface during rotation of the bending tool.

* * * * *